US008763704B2

(12) United States Patent
Pettigrew

(10) Patent No.: US 8,763,704 B2
(45) Date of Patent: Jul. 1, 2014

(54) HIGH PRESSURE HYDROCARBON FRACTURING ON DEMAND METHOD AND RELATED PROCESS

(75) Inventor: Dana Pettigrew, Airdrie (CA)

(73) Assignee: Nexen Energy ULC, Calgary, Alberta (CA)

( * ) Notice: Subject to any disclaimer, the term of this patent is extended or adjusted under 35 U.S.C. 154(b) by 228 days.

(21) Appl. No.: 13/328,245

(22) Filed: Dec. 16, 2011

(65) Prior Publication Data

US 2012/0160502 A1 Jun. 28, 2012

Related U.S. Application Data

(60) Provisional application No. 61/426,123, filed on Dec. 22, 2010, provisional application No. 61/434,167, filed on Jan. 19, 2011, provisional application No. 61/434,171, filed on Jan. 19, 2011.

(51) Int. Cl.
*E21B 43/26* (2006.01)

(52) U.S. Cl.
USPC ..... 166/308.3

(58) Field of Classification Search
None
See application file for complete search history.

(56) References Cited

U.S. PATENT DOCUMENTS

| | | | |
|---|---|---|---|
| 3,861,825 | A | 1/1975 | Blom |
| 5,232,342 | A | 8/1993 | Thompson |
| 6,960,330 | B1 | 11/2005 | Cox, Jr. |
| 7,575,052 | B2 | 8/2009 | Sandberg et al. |
| 2005/0098504 | A1 | 5/2005 | Manz et al. |
| 2010/0022436 | A1 | 1/2010 | Durant et al. |
| 2010/0272595 | A1 | 10/2010 | Maziasz et al. |

OTHER PUBLICATIONS

Johnson, Elizabeth, Water Research, Ministry of Energy, Mines and Petroleum Resources, Resource Development and Geoscience Branch, 2009.

Pond, J., et al., Horn River Frac Water: Past, Present, and Future (abstract), Canadian Society for Unconvential Gas, Society of Petroleum Engineers, 2010.

*Primary Examiner* — Zakiya W Bates
(74) *Attorney, Agent, or Firm* — Fay Sharpe LLP

(57) ABSTRACT

A method or process for hydraulically fracturing an underground hydrocarbon deposit includes using as a source of water an underground aquifer which contains water which is stable and clear in the aquifer but which may include undesirable chemical compounds as soluble components that are not in solution when subjected to reduced pressure at atmospheric conditions. Water from the aquifer is used as a source of water for the hydrocarbon fracturing process. The water is pumped at a pressure above its bubble point pressure A source well and a disposal well are drilled into the aquifer. A pump capable of maintaining the water above its bubble point pressure is provided, and a closed loop is established with a manifold, or a manifold and pumps, to keep the aquifer water circulating at a pressure above its bubble point pressure. The hydrocarbon reserve is fractured using the water.

11 Claims, 6 Drawing Sheets

HIGH PRESSURE HYDROCARBON FRACTURING ON DEMAND METHOD AND RELATED PROCESS

FIELD OF THE INVENTION

There is a need for substantial amounts of water for hydraulic fracturing operations. A potential exists in many areas to access and use a non-potable water aquifer formation for this purpose. An example would be the Debolt aquifer or the like, which was tested successfully.

BACKGROUND OF THE INVENTION

Nexen Inc. ("Nexen"), the assignee, has natural gas shale deposits in northeast British Columbia. Efficient and cost effective production of the natural gas shale deposits in the area is dependent upon the availability of water for fracturing operations. The expected daily gas production in the area will require an estimated annual volume of at least 1.3 MM $m^3$ of water with such water generally coming from natural above ground sources and/or pre-treated underground sources. In order to maximize the value of this natural gas reserve, a reliable supply of sufficient quantities of water for fracturing stimulation programs is necessary to enable the delivery of the projected production levels.

One of the opportunities for achieving value is to streamline the process for providing water for frac programs through the innovative use of non-potable water.

It is therefore a primary object of this invention to provide a method and process for fracturing a hydrocarbon reservoir utilizing water from an aquifer adjacent said reservoir. The suitable aquifer could also be nearby and be either shallower or deeper than the said reservoir.

It is another object of the invention to use the method and process when fracturing a natural gas reserve.

It is yet another object of the invention to avoid treating the aquifer water prior to using it for hydrocarbon fracturing.

It is a further object of the invention to use the Debolt aquifer as a source of water for the fracturing of a natural gas reserve.

It is another object of the invention to provide said fracturing pump with construction materials in alignment with the well known recommendations published for material performance criteria from for example NACE, ASTME or ANSI trim packaging or the like in view of the corrosive nature of the fluids being pumped).

Further and other objects of the invention will be apparent to one skilled in the art when considering the following summary of the invention and the more detailed description of the preferred embodiments described and illustrated herein along with the appended claims.

SUMMARY OF THE INVENTION

The Debolt subsurface formation or zone is an aquifer whose water contains approximately 22,000 ppm of total dissolved solids ("TDS") and a small amount of hydrogen sulphide—$H_2S$. The scope and volume of the Debolt formation is still being investigated, but it has the potential to be extensive. This aquifer has high permeability and porosity. A Debolt well at b-H18-1/94-O-8 was tested in May, 2010, with a 10.25" 900 HP downhole electrical submersible pump ("ESP"). The well showed a Productivity Index of 107 m3/d per 1 kPa drawdown, indicating that the reservoir will provide a high enough rate of flow to support the volume and rate requirements needed to support well fracturing operations.

Debolt formation water contains sour gas in solution. When depressurized to atmospheric conditions, the Debolt water flashed off sour gas at a gas water ratio of 1.35 standard $m^3$ of gas to 1 $m^3$ of water. The flashed gas contained 0.5% $H_2S$, 42% $CO_2$ and 57% $CH_4$ (methane). These gases are the same gases present in shale gas production being performed, which is normally in the range of 0.0005% $H_2S$, 9% $CO_2$, and 91% $CH_4$ (methane), and the use of raw Debolt water would have a negligible impact on the current percentage of shale gas components.

The challenge is how to use sour water, for example Debolt water, for fracing in a cost effective manner since current water fracturing equipment does not comply with the well known recommendations published for material performance criteria from for example NACE, ASTME or ANSI standards for trim packaging or the like. Current water frac contractors are reluctant to use Debolt water for fracturing operations. In part because current equipment is not NACE complian. But the primary reason relates to safety concerns with respect to $H_2S$ content of the Debolt water.

There are two different ways of using Debolt formation water for fracturing operations. The first is to construct and operate a water treatment plant to remove the $H_2S$ from Debolt water. This approach has been taken by other industry participants who have constructed an $H_2S$ stripping plant to remove the $H_2S$ from Debolt water. A recent paper published by Canadian Society for Unconventional Resources entitled "Horn River Frac Water: Past, Present, Future" discusses the technical and operational aspects of the Debolt Water Treatment Plant constructed and operated for the foregoing purposes. This paper states that a very expensive treatment plant is required to remove the $H_2S$ and other solution gases from the Debolt water.

The second approach is to maintain the aquifer water at a pressure above its saturation pressure (also known as the "Bubble Point Pressure" or "BPP") on a continuous basis while being produced to surface and transported in pipelines to enable it to be used for fracturing. Tests conducted on the Debolt water properties indicates that as long as the Debolt water is maintained at a pressure high enough to keep the solution gas entrained in the water, the water is stable with no precipitates, and remains crystal clear in colour. Further the water is in the least corrosive state. These findings reveal that the Debolt aquifer fluid can be used in its natural state requiring no treatment. This is the basis of the proprietary Pressurized-Frac-on-Demand ("PFOD") process.

The primary aspect of this invention is therefore to provide a method or process of fracturing a hydrocarbon deposit on demand comprising the steps of:

using as a source of water an underground aquifer which contains water which is stable and clear in the aquifer but which may include undesirable constituents that are in solution when subjected to surface conditions such as hydrogen sulfide and other constituents, utilizing the water from the aquifer as a source of water to be used in a hydrocarbon fracturing process and to pump the water under pressure at a predetermined rate for the aquifer water and above the bubble point pressure (BPP) for the water contained in a particular aquifer to keep the water stable. We have found that the water becomes unstable when the pressure is reduced and gas is allowed to evolve out of the water. This depressuring and gas removal initiates a chemical reaction with the dissolved solids in the water to cause precipitates to form. To prevent these chemical reactions from occurring and causing the undesirable constituents of said water from falling out of solution, maintaining said water pressure at a minimum required for each aquifer at all times during the fracturing process, drilling a source well into the aquifer, drilling a disposal well to the aquifer, providing a pump capable of maintaining the required pressure needed to prevent the constituents of the aquifer water from coming out of solution only by maintaining the minimum pressure, establishing a closed loop with a manifold, or a manifold and pumps, to keep the aquifer water circulating at all times until the fracturing operation begins when water will be supplied from that manifold, providing the fracturing operation with water from the manifold so as to fracture a hydrocarbon reserve, wherein in using water from an aquifer in the fracturing process and by maintaining said water under pressure at a minimum at all times, said water remains stable and the undesirable constituents remain in solution and the water remains clear thereby avoiding the necessity of treating the water from the aquifer prior to using it in a fracturing processes.

According to another aspect of the invention there is provided a method or process of high-pressure fracturing of a hydrocarbon deposit, for example a shale gas deposit on demand comprising the steps of using as a source of water from an underground aquifer such as the Debolt aquifer which contains sour water including $H_2S$ and other constituents, utilizing the sour water from the aquifer as the water source to be used preferably on at least the clean side of a gas fracturing process and to pump said sour water under pressure at a minimum of for example 2310 kPa for Debolt water at approximately 38 degrees Celsius (which varies with the actual temperature of source water for each aquifer, and any surface cooling which may occur to such water) and above the BPP for the sour water contained in a particular aquifer to prevent $H_2S$ and other constituents of said sour water from falling out of solution, maintaining said sour water pressure at a minimum required for each aquifer, for example for Debolt of 2310 kPa at all times during the fracturing process, drilling a source well into the aquifer, drilling a disposal well into the aquifer, providing a pump capable of maintaining the required pressure needed to prevent the constituents of the sour water from coming out of solution only by maintaining the minimum pressure required which, for example, for Debolt water is 2310 kPa at 38 degrees Celsius, establishing a closed loop with a manifold to keep the sour water circulating at all times until the well fracturing operation begins when water will be supplied from that manifold, or a manifold and pumps, providing the clean side of a well fracturing operation with sour water from the manifold so as to fracture a well reserve (normally an oil or gas zone reserve), wherein in using sour water from an aquifer such as Debolt for the gas fracturing process and maintaining said sour water under pressure at a minimum, as an example for Debolt water being at 2310 kPa and 38 degrees Celsius, said water remains stable and the constituents remain in solution and the water remains clear thereby avoiding the necessity of stripping out the hydrogen sulfide and other constituents as is required by other well fracturing processes.

In one embodiment of the invention said water source and method or process is utilized along with sand on the dirty side of the well fracturing operation with the addition of a high-pressure blender since the sour water must be maintained above its BPP, for example 2310 kPa for Debolt water at 38 degrees Celsius at all times thereby avoiding the constituents including the $H_2S$ from falling out of solution.

In a further embodiment of the method or process the necessary number of pumps and source wells and disposal water wells are provided with the method or process to enable a high-pressure fracturing operation on demand for a target number of fracs (which depends on the particular well design chosen for a reservoir stimulation or other purpose) for each well, or number of wells, stimulated as part of a program.

Preferably in the method or the process said water from the source aquifer is at an elevated temperature, for example for Debolt water a temperature under normal circumstances has been 38 degrees Celsius, which therefore requires no additional heating, or insulated piping, and which may be used as a source of sour water for the pressurized fracturing on demand process even during the colder winter months experienced in, for example, Western Canada or similar areas and which can contribute considerable cost savings when compared to utilizing surface water.

In yet another embodiment the method or process utilizes sour water from the Debolt aquifer and continuously circulates said water at a pressure above the BPP from the source well to the disposal well in an underground pipeline system accomplished by a back pressure control valve located downstream of the well to be fractured near the Debolt water circulation line and yet upstream of the disposal wells wherein when water is required for frac operations, water will be withdrawn from a manifold strategically located on this circulation line thereby feeding Debolt water to the frac operation under pressure, which is above the Debolt BPP.

According to yet another embodiment of the method or process the Debolt water is maintained at a pressure above its saturation pressure and is continuously used for fracing so that as long as the Debolt water is maintained at a high enough pressure to keep the solution gas entrained in the water, then the water remains stable, with no precipitates and is in the least corrosive state thus requiring that all frac operations (at least on the clean side) be conducted at pressures above the Debolt water BPP which is the basis for a successful PFOD process.

In yet another embodiment the method or process further comprises a NACE trim, preferably a High Pressure Horizontal Pumping System ("HPHPS") frac pump capable of providing a discharge pressure of about 69 MPa. The pump construction uses materials in alignment with the recommendations published by the National Association of Corrosion Engineers ("NACE") trim packaging in view of the corrosive nature of the fluids being pumped). Alternatively, materials may be selected from material performance criteria for a HPHPS frac pump or equivalent published by for example ASTME, ANSI or the like.

In order to carry out the process of this invention, a multi-stage centrifugal pump is built capable of delivering a discharge pressure or differential pressure between pump internal and external pressures to over 10,000 psi. A pressure sleeve or pump housing is designed to be the primary pressure containment. The sealing interface between the pump base and pump head is a metal on metal type achieved by using specialized thread. The diffusers are designed with openings to allow rapid pressure equalization across the diffuser outside edge to avoid failure from high differential pressure which could cause diffuser failure. A seal is used on the outside of the diffusers to prevent pressure communication, and fluid flow, between the outside of the individual diffusers enclosed within the housing. The pump connections to pump intake and discharge are upgraded to ring or gasket style sealing.

The present invention also relates to a multistage centrifugal pump design, which has the diffusers, impellors, and a shaft, inserted within a high pressure housing or barrel, wherein this assembly is fully enclosed within the housing, and the housing is of sufficient strength to be suitable for safe pressure containment of the fluids being pumped. This aspect of the invention describes the technical details used to reconfigure the known multistage centrifugal pump design to enable increase of the discharge pressure capabilities higher than the 6,000 psig of current designs. The design modifications discussed herein have been successfully tested at 10,000 psig discharge pressure. The 10,000 psig pressure capability provides a pressure suitable for fracturing formations penetrated by wellbores.

This style of pump unit is well suited to the hydrocarbon fracturing industry to be used to pump fluids at sufficient pressures, to stimulate oil and gas reservoirs.

The invention is a housing type of centrifugal pump, which is designed for operating at speeds of 30 to 90 hz, (1800 to 5400 rpm), with discharge pressures that may be 10,000 psig, and with a suction pressure that may be 15-600 psig. Fora 10,000 psig discharge pressure capability, such as this multistage centrifugal pump design enclosed within a housing, this is a more economical cost effective option as compared to prior structures such as a split casing multistage centrifugal pump.

Preferably said pump is utilizing pressure sleeve (21) on top of diffuser (22) wall for improved wall strength by compression fit between sleeve (21) and outside diameter of diffuser (22) wall.

Also preferably said pump is utilizing equalizations hole (23) in diffuser wall, resulting in zero deferential pressure across diffuser wall and also allows for rapid depressurizing.

Preferably to prevent stages from collapsing due to pressure transfer from one pump stage to another o-ring (31) style sealing is utilized between each diffuser (34) and housing (33).

In one embodiment sealing between pump housing (16) and both pump base (12) and pump head (19) is by specialized threads providing metal on metal sealing, eliminating all elastomeric and non-elastomeric seals through the use of proven metal-to metal thread sealing technology such as Base/Head Pin-Housing Connection).

The multistage centrifugal pump is designed for injecting fluids to a wellbore for purpose of fracturing this well.

According to that aspect of the invention there is provided a multiple stage centrifugal pump for fracturing hydrocarbon deposits capable to deliver discharge pressure or differential pressure between the pump internal and external pressure to be over 10,000 psi and including a pressure sleeve or pump housing designed for the primary pressure containment, sealing between the pump base and pump head is metal on metal type achieved by using specialized thread, diffusers are included designed with openings to allow rapid pressure equalization across the diffuser outside edge to avoid failure from high differential pressure which could cause diffuser failure, a seal is used on the outside of the diffusers to prevent pressure communication, and fluid flow, between the outside of the individual diffusers enclosed within the housing and the pump connections to pump intake and discharge are upgraded to ring or gasket style sealing.

DETAILED DESCRIPTION OF THE PREFERRED EMBODIMENTS

Figure 1:
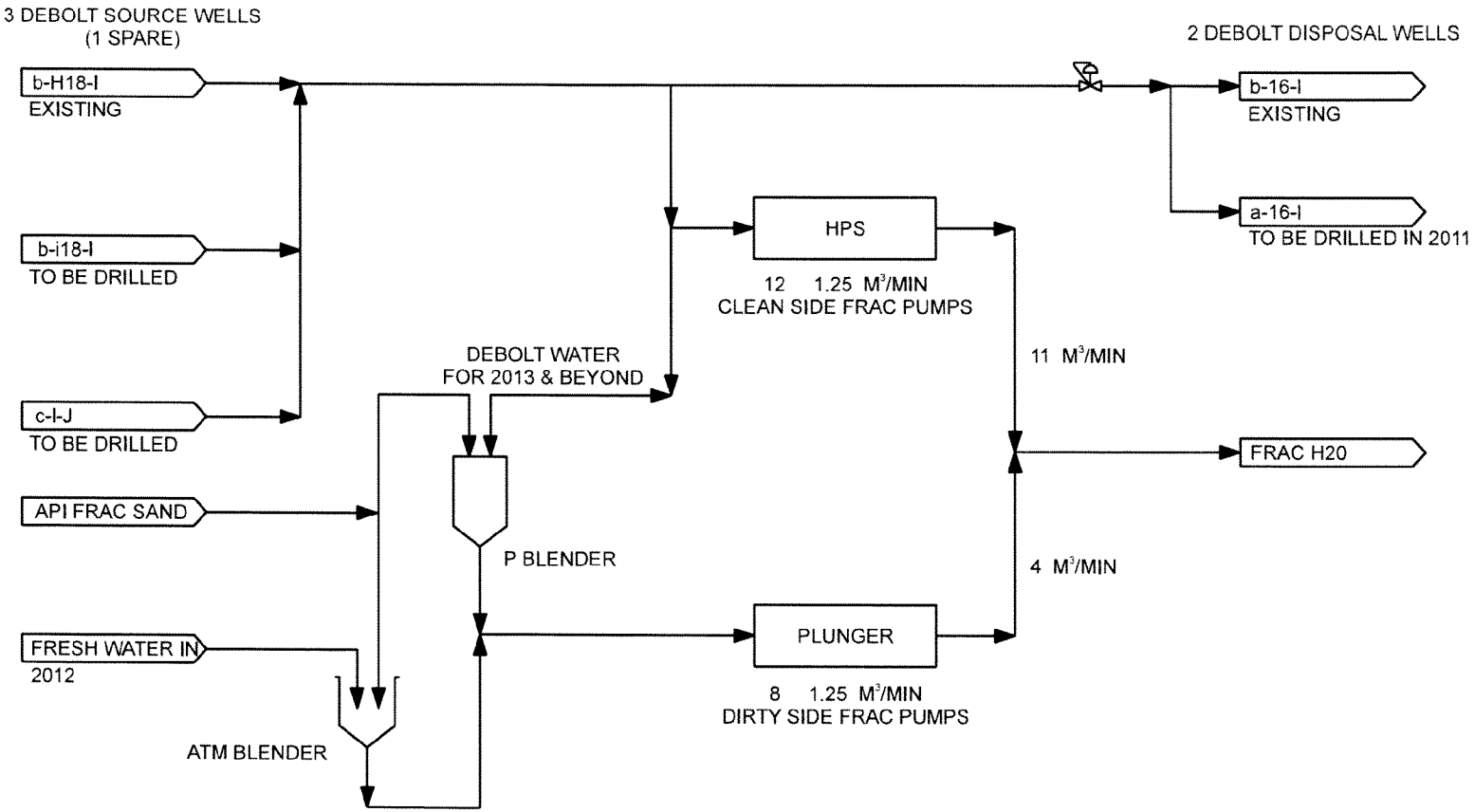
FIG. 1 is a PFOD Flow Schematic.
Figure 2:
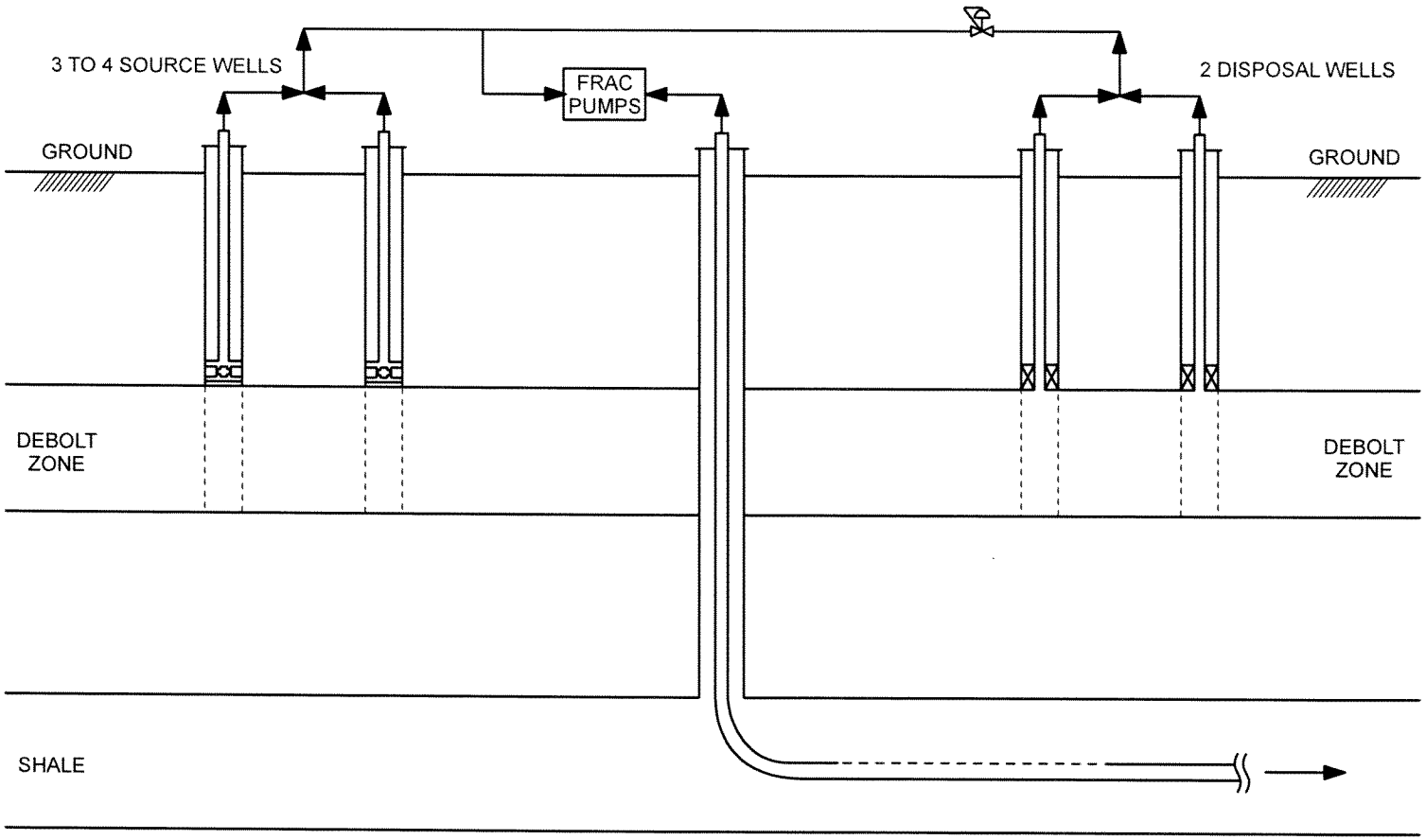
FIG. 2 is a PFOD Elevation View.

Over the past two years, Nexen has been working on the PFOD process as outlined below, using Debolt water above its BPP for fracing thus eliminating the need for an expensive $H_2S$ removal process.

In order to guarantee a reliable source of water for its fracturing operations, it was necessary to identify ways to utilize the Debolt water as part of the frac water source. One of the options reviewed was to use Debolt water for only the clean side of the frac program.

In light of its requirements, Nexen designed and built a small flow HPHPS frac pump for testing. In June 2010, a 0.25 $m^3$/min NACE trim HPHPS test frac pump capable of providing a discharge pressure of 69 MPa was tested on the b-18-1 pad in northeast British Columbia. Technicians were onsite to operate the Debolt water source well ("WSW") ESP and the HPHPS test frac pump. Three chokes consisting of two bean types and one variable choke were piped up in series to provide the back pressure to test the HPHPS frac pump at fracturing pressure.

In the initial tests, the HPHPS test frac pump used freshwater from a tank truck. All the pump control parameters were set. In subsequent tests, Debolt water was used and fed by the Debolt WSW at b-H18-I/94-O-8 by ESP to the suction of the HPHPS test frac pump. The discharge from the test frac pump flowed through three chokes at various back pressures. The Debolt water then exited the chokes and flowed into a disposal water pipeline to the water disposal well ("WDW") at b-16-I. The back pressure was progressively increased at 7000 kPa intervals and ran at that discharge pressure for approximately 30 to 60 minutes. When pump operations remained steady, the choke was adjusted to increase the discharge pressure of the pump.

The HPHPS frac test pump was successfully tested on July 7 and 8, 2010. It operated at a discharge pressure of 71 MPa. The pump was run using Debolt water for approximately 6 hours at 62 MPa to simulate a complete fracturing operation.

It is understood that for other aquifers will have different physical parameters. For example pump specifications will reflect different Bubble Point Pressures for alternative water sources. For the Debolt water source, the BPP of the aquifer water was 2310 kPag at 38 degrees Celsius.

In August 2010 during the completion of the 8 wells at pad b-18-1, the HPHPS test frac pump was integrated into six fracturing operation. Three of the 6 fracs ran using freshwater and three ran using Debolt water. The HPHPS test frac pump ran well for all 6 fracs and there were no operational or safety issues encountered.

Only one source water well and one disposal well are required for the initial testing of the PFOD system, and additional wells will provide increased capacity and backup to ensure minimum flow rate and injection capacities are available as required for the system to operate reliably with maximum system availability and use. Nexen is planning to drill and complete additional Debolt formation WSWs and additional Debolt WDW in the future as required to optimize the Debolt water system to support fracturing operations. Together with the existing b-H18-I Debolt WSW and the existing Debolt WDW b-16-I, these 2 initial wells plus any additional wells will form the basis of the PFOD water circulation system identified for such well fracturing program.

Nexen will continue to further evaluate the need to source and test a 1.25 m3/min full size 3000 kPa suction pressure for a trim plunger frac pump for the dirty side based on the well known recommendations published for material performance criteria from for example, NACE, ASTME or ANSI trim packaging or the like. This also includes the evaluation of the need for a pressurized blender, or another method for utilizing Debolt water for the dirty side.

Based on the Debolt water well tests conducted in June 2010, a feasibility study of the PFOD process, and initial field testing of a prototype NACE trim HPHPS frac pump in July and August of 2010, it was concluded:

- It is technically and economically feasible to use Debolt water in its untreated state for fracturing operations.
- It is possible using the PFOD process to maintain pressures above 2310 kPa (BPP for Debolt water) thus keeping gases including $H_2S$ contained in solution.
- No compatibility issues have arisen using Debolt water for fracturing or injection into shale.
- A HPHPS NACE trim frac pump using Debolt water can be constructed and used on the clean side of fracturing operations.
- No operational or safety issues were identified during the testing and ultimate use in the field of the HPHPS frac pump.
- Freshwater may not be readily available for operations. Water from Debolt using PFOD process is readily available availability is not subject to spring and summer rainfall or suspension of licenses due to drought. For example, in August, 2010, government regulators in British Columbia suspended freshwater withdrawal licenses for hydrocarbon fracturing operations in the Montney area due to a drought in the Peace River watershed.
- There is experience in the pump industry in building a high suction pressure plunger style pump, with a NACE trim fluid end. There is no experience in the frac pump industry in building a high suction pressure (over 330 prig (2300 kpag)) plunger style frac pump, with a NACE trim fluid end, capable of pumping American Petroleum Institute ("API") quality frac sand for the dirty side fracing.
- There is no apparent technical limitation or constraint to prevent the engineering and fabrication of a pressure blender to use Debolt water under pressure.

The PFOD Process

The PFOD process maintains Debolt water at a pressure above its BPP at all times in order to prevent gases (including $H_2S$, $CO_2$ and $CH_4$) from coming out of solution. Based on Debolt well formation water and Pressure-Volume-Temperature ("PVT") tests, the Debolt water BPP is 2310 kPa (335 Psi) at 38 degrees Celsius. When the Debolt water at 38 degrees Celsius was de-pressurized to atmospheric pressure, approximately 1.35 $m^3$ gas was released per $m^3$ of water. The flashed gas contained 0.5% $H_2S$, 42% $CO_2$ and 57% $CH_4$ (methane). These are the same gases present in certain shale gas operations (normally 0.0005% $H_2S$, 9% $CO_2$, and 91% $CH_4$ (methane). The use of raw Debolt water would have negligible impact on the current percentage of shale gas components content.

For the typical PFOD system, a total of 3 Debolt WSWs and 2 Debolt WDWs will be required. These WSWs and WDWs will be centrally located for two to three identified well pads selected for development. Debolt water will be continuously circulated at a pressure above the BPP from the WSWs to the WDWs in an underground pipeline system. This will be accomplished by a back pressure control valve located downstream of the well to be fractured near the Debolt water circulation line and yet upstream of the disposal wells wherein when water is required for frac operations, water will be withdrawn from a manifold strategically located on this circulation line thereby feeding Debolt water to the frac operation under pressure, which is above the Debolt BPP. The two figures show a PFOD flow schematic and a subsurface elevation view. These figures demonstrate how the PFOD pipeline system would work.

The advantages of a PFOD process are numerous and include the following:

- Fracturing operations can to be conducted on a continuous basis year round. Debolt water is typically at 38 degrees Celsius. This allows for the use of Debolt water in the winter months without requirement for heating or the other infrastructure often required for winter frac operations including insulated pipelines for water circulation. Furthermore, service contractors for fracturing operations tend to be more available during non-peak winter months.
- Year round fracing capability will allow for production flexibility relative to commodity demand and pricing.
- The PFOD process eliminates the intensive capital and operation costs associated with building, operating and maintaining water treatment facilities.
- The PFOD process also reduces the need for secondary facilities that are required as development of fracturing operations occurs at greater distances from the water treatment and $H_2S$ removal plants.
- The PFOD process eliminates the need for above ground treated water storage tanks or large holding ponds that would ordinarily be required to heat the water for an above ground treatment process. The Debolt aquifer therefore acts as a natural storage tank with no surface facilities, heating or maintenance required.
- The Debolt aquifer could also be used as the main storage location of excess fresh water to be used later during a fracturing operations.

PFOD Pump Details

Figure 3:
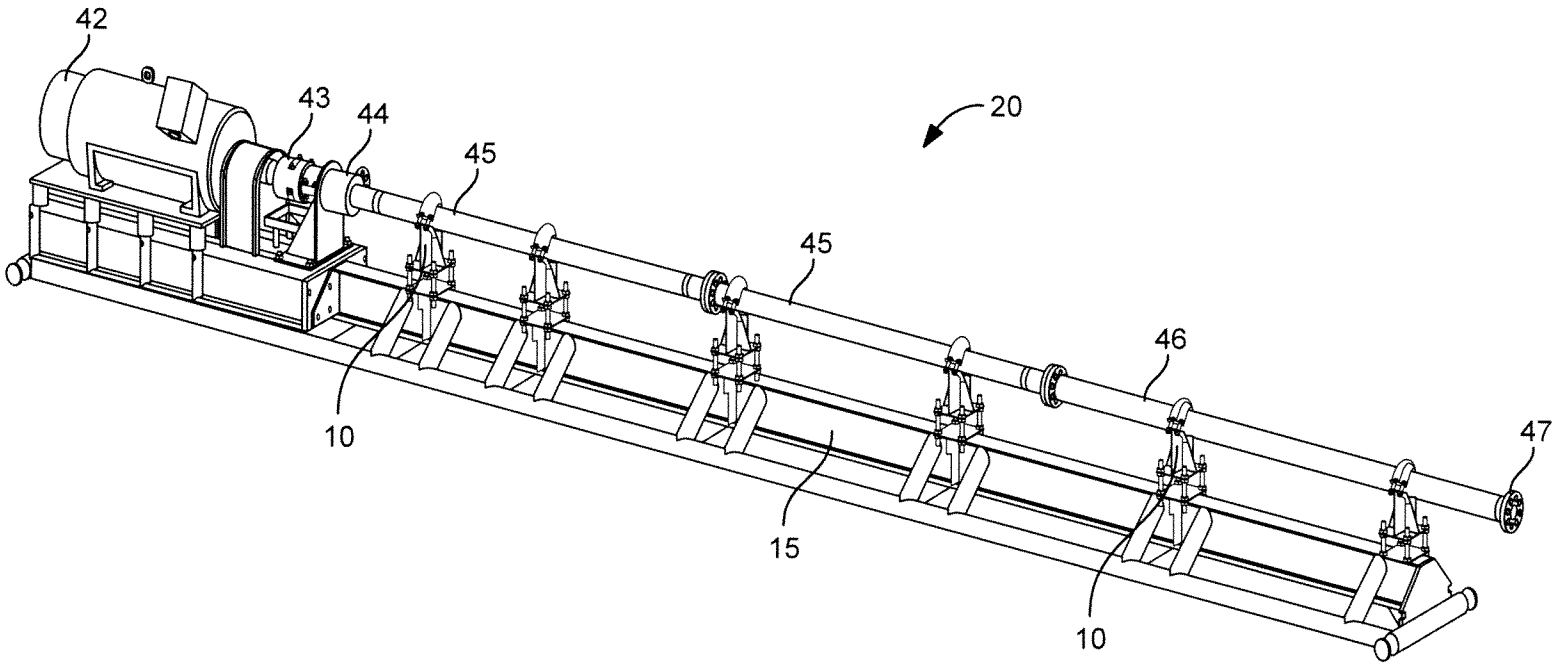
FIG. 3 is a drawing of a high pressure multistage centrifugal pump assembly illustrating and describing all key components used within the pump assembly.

FIG. 3 illustrates a High Pressure multistage centrifugal pump assembly describing all components used in a preferred embodiment as follows:

- 15 pump support—skid frame.
- 42 pump driver—electric motor.
- 43 thrust chamber to support shaft load from pump.
- 44 pump intake section example.
- 45 Shows a low pressure multistage centrifugal pump housings containing the diffusers, impellors and shaft. Two pump sections are shown. Maximum design was to 6,000 psi discharge pressure.
- 46 Shows the high pressure multistage centrifugal pump housing containing the diffusers, impellors and shaft. This is the inventive aspect that takes the pressure capability from 6,000 psig up to 10,000 psig discharge pressure.

47 High pressure discharge head for 10,000 psig. This is the invention aspect that takes the pressure capability from 6,000 psig up to 10,000 psig discharge pressure.

Figure 4:
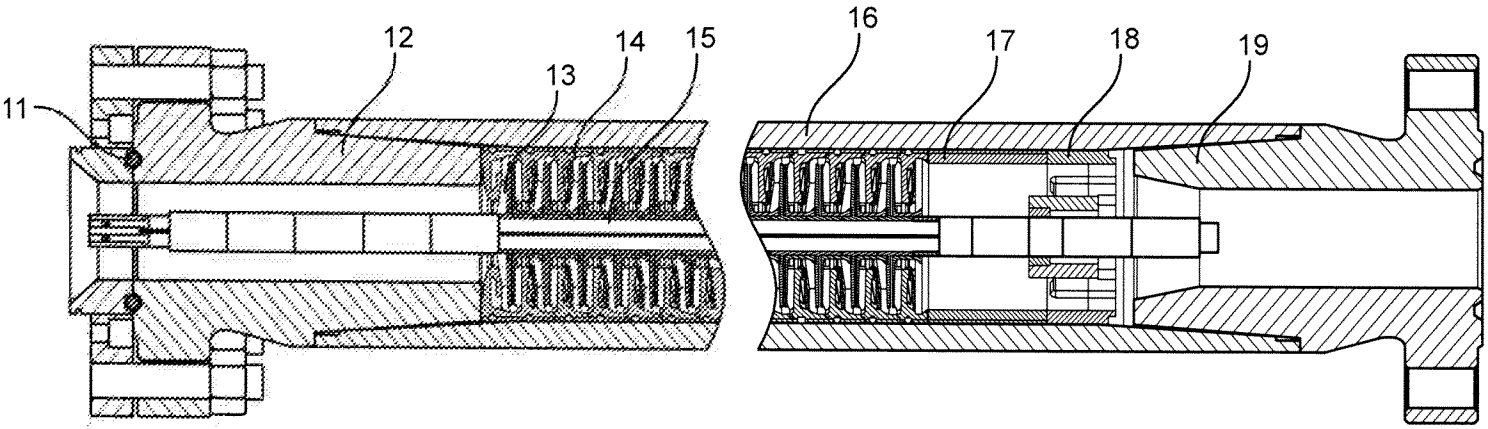
FIG. 4 is a cross section drawing of the high pressure multistage centrifugal pump assembly describing the components used within assembly.

FIG. 4 is a cross section drawing of High Pressure multistage centrifugal pump assembly of the invention describing all components used within assembly including pump base (12) and pump head (19) threaded into pump housing (16). Pump stage is an assembly of impeller (13) and diffuser (14). The impellers (13) are install on pump shaft (15) and are the rotating part of the pump. The diffusers (14) are fixed in the pump assembly by being compressed by compression bearing (18) in the pump housing (16) and against pump base (12).

Figure 5:
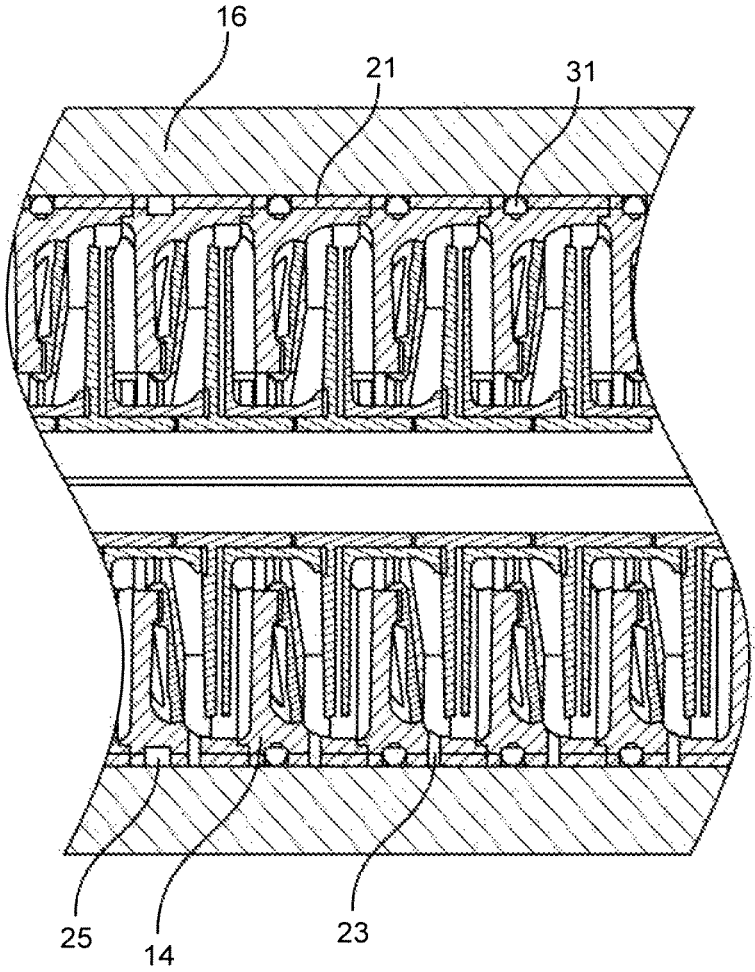
FIG. 5 is a cross sectional illustration showing a number of impellor and diffuser stages in the high pressure multistage centrifugal pump housing.

FIG. 5 is a cross section drawing showing a number of impellor and diffuser stages in the High Pressure multistage centrifugal pump housing (16). This invention includes the equalization hole (23) for rapid depressurizing, and the support sleeve (21) completely around the diffuser, which has grooves (25) to contain the O-Ring (31) to prevent pressure communication, and fluid flow, between the outside of the individual diffusers enclosed within the housing. This high pressure housing (33) is designed to safely contain pressures up to 10,000 psig.

Figure 6:
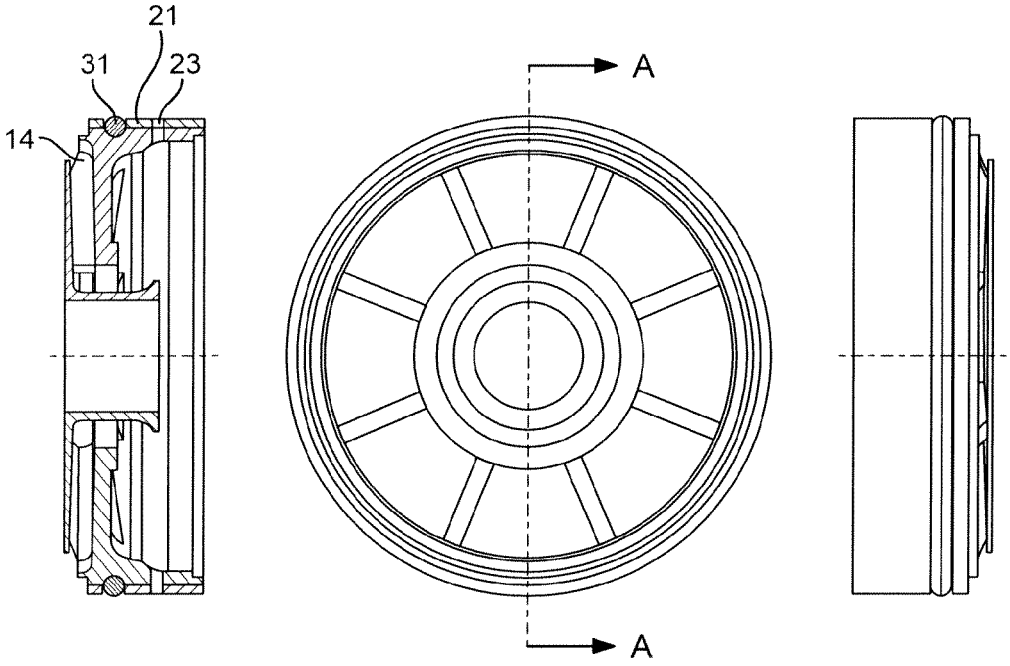
FIG. 6 is a cross sectional illustration of diffuser, for the high pressure multistage centrifugal pump assembly and diffuser details showing compression sleeve (21) on top of diffuser (22).

FIG. 6 is a cross section drawing of the diffuser, for the High Pressure multistage centrifugal pump assembly and diffuser details showing compression sleeve (21) on top of diffuser (22). This invention includes the equalization hole (23) for rapid depressurizing, and the O-Ring (31) to prevent pressure communication, and fluid flow, between the outside of the individual diffusers enclosed within the housing

CONCLUSIONS

Any fracturing operation requires large volumes of water. The PFOD process provides an alternative to use of fresh or treated subsurface water. The Debolt formation in northeast British Columbia has proven to contain non-potable water at volumes necessary for fracturing operations. The PFOD process eliminates water treatment by maintaining gases and particulates in solution thus allowing for use of natural untreated sour aquifer water for example as found in the Debolt aquifer or the like. This is accomplished by maintaining water pressure above the BPP eliminating costly water treatment and secondary facilities, replacing the use of freshwater by non-potable subsurface sour water, and decreasing the environmental footprint of fracturing operation.

As many changes therefore may be made to the preferred embodiment of the invention without departing from the scope thereof. It is considered that all matter contained herein be considered illustrative of the invention and not in a limiting sense.

The invention claimed is:

1. A method or process for hydraulically fracturing an underground hydrocarbon deposit comprising the steps of:

using as a source of water an underground aquifer which contains water which is stable and clear in the aquifer but which may include undesirable chemical compounds as soluble components that are not in solution when subjected to a relatively reduced pressure at atmospheric conditions, utilizing the water from the aquifer as a source of water for a hydrocarbon fracturing process, pumping the water under pressure at a predetermined level for the aquifer water and above a bubble point pressure for the water contained in the aquifer to prevent the undesirable chemical compounds in said water from separating out of solution, maintaining said water pressure above the bubble point pressure at all times during a fracturing operation, drilling a source well into the aquifer, drilling a disposal well into the aquifer, providing a pump capable of maintaining the water above the bubble point pressure, establishing a closed loop with a manifold, or a manifold and pumps, to keep the aquifer water circulating at all times until the fracturing operation begins when water will be supplied from that manifold, providing the fracturing operation with water from the manifold, or a manifold and pumps, so as to fracture the hydrocarbon deposit, wherein in using water from the aquifer in the fracturing operation and by maintaining said water above its bubble point pressure, said water remains stable and the undesirable chemical compounds remain in solution and the water remains clear.

2. The method of claim 1 wherein the soluble components in the water from the source aquifier are at about 22,000 ppm.

3. A method or process of high-pressure fracturing of a shale gas deposit comprising the steps of:

using as a source of water an underground aquifer which contains sour water including hydrogen sulfide, utilizing the sour water from the aquifer as a source of water to be used on at least a clean side of a fracturing operation, pumping said sour water under pressure and above a bubble point pressure for the sour water contained in the aquifer to prevent hydrogen sulfide from falling out of solution, maintaining said sour water pressure above the bubble point pressure at all times during the fracturing operation, drilling a source well into the aquifer, drilling a disposal well into the aquifer, providing a pump capable of maintaining the water above the bubble point pressure, establishing a closed loop with a manifold, or a manifold and pumps, to keep the sour water circulating at all times until the fracturing operation begins when water will be supplied from that manifold, providing the clean side of the fracturing operation with sour water from the manifold, or a manifold and pumps, so as to fracture the shale gas deposit, wherein in using sour water from the aquifer for the fracturing operation and in maintaining said sour water above its bubble point pressure, said water remains stable and the constituents remain in solution and the water remains clear.

4. The method or process of claim 1 or 3 wherein said water source is utilized along with a sand on a dirty side of the hydrocarbon deposit or shale gas deposit fracturing operation.

5. The method or process of claim 1 or 3 further comprising providing a plurality of pumps and source wells and disposal water wells to enable the fracturing operation to occur on demand for each pad of a predetermined number of pads.

6. The method or the process of claim 1 or 3 wherein said water from the source aquifer is kept at an elevated temperature in relation to ambient surface water.

7. The method or process of claim 6 wherein the elevated temperature of the water from the source aquifier is about 38° C.

8. The method or process of claim 1 or 3 further comprising providing an underground pipeline system including a water circulation line and a back pressure control valve located in the water circulation line wherein the pipeline system is in communication with the manifold or the manifold and pumps, and wherein when water is required, it will be withdrawn from the manifold, or the manifold and pumps.

9. The method or process of claim 1 or 3 further comprising providing a high pressure blender to maintain the water above its bubble point pressure.

10. The method or process of claim 1 or 3 wherein after pumping, the water is discharged at a pressure of about 6,000 to 10,000 psig.

11. The method or process of claim 10 wherein a suction pressure employed for a pump utilized in the process is about 15 to 600 psig.

* * * * *